US005526989A

United States Patent [19]

Staples et al.

[11] Patent Number: 5,526,989

[45] Date of Patent: Jun. 18, 1996

[54] METHOD OF OPERATION OF POSITIVE GUIDANCE SYSTEM FOR A TANK-CLEANING DEVICE

[76] Inventors: Wesley A. Staples, Rte. 3, Box 1512; Russell E. Staples, Rte. 5, Box 8082, both of Palatka, Fla. 32177

[21] Appl. No.: 286,952

[22] Filed: Aug. 8, 1994

[51] Int. Cl.[6] ..... B02C 23/00; B02C 23/36

[52] U.S. Cl. ..... 241/25; 241/30; 15/246.5; 134/23

[58] Field of Search ..... 15/1.7, 56, 246.5; 134/18, 22.1, 23, 168 R; 241/21, 25, 27, 30; 414/304, 306

[56] References Cited

U.S. PATENT DOCUMENTS

| | | | |
|---|---|---|---|
| 2,714,080 | 7/1955 | Kennedy et al. | 134/24 |
| 3,416,176 | 12/1968 | Ravitts | 15/1.7 |
| 3,658,589 | 4/1972 | Shaddock | 134/10 |
| 3,782,697 | 1/1974 | Karg | 259/24 |
| 3,826,371 | 7/1974 | Adamson | 210/169 |
| 3,844,540 | 10/1974 | Dobbs | 259/2 |
| 4,015,613 | 4/1977 | Papworth | 134/102 |
| 4,152,800 | 5/1979 | Nilsmar | 15/1.7 |
| 4,168,562 | 9/1979 | Maasberg | 15/320 |
| 4,341,232 | 7/1982 | Maton | 134/107 |
| 4,422,771 | 12/1983 | Earhart et al. . | |
| 4,626,358 | 12/1986 | Fetsko | 210/776 |
| 4,805,650 | 2/1989 | Yasui et al. | 134/57 |
| 4,828,625 | 5/1989 | Moran | 134/22.18 |
| 4,859,249 | 8/1989 | Valentini | 134/22.18 |
| 5,037,486 | 8/1991 | Sloan | 134/18 |
| 5,087,294 | 2/1992 | Rechtzigel | 134/22.1 |
| 5,093,949 | 3/1992 | Sloan | 15/319 |
| 5,185,899 | 2/1993 | Urbani . | |
| 5,198,125 | 3/1993 | Coudriet | 210/803 |
| 5,253,812 | 10/1993 | Staples et al. | 241/21 |
| 5,279,012 | 1/1994 | Sloan . | |
| 5,286,384 | 2/1994 | Haag | 210/527 |

*Primary Examiner*—Timothy V. Eley

*Attorney, Agent, or Firm*—Kerkam, Stowell, Kondracki & Clarke; John C. Kerins

[57] ABSTRACT

A guidance system and method for positively guiding a tank sludge-removal unit or the like around the inside of a tank, including a plurality of winch assemblies mounted at radially spaced locations on the top perimeter of the tank each having a control line which extends into the tank for connecting either directly to the unit or indirectly to a lifting line via a pulley device used for raising and lowering the unit within the tank, thereby enabling the position and/or the direction of movement of the unit to be positively controlled by selective operation of the winch assemblies and/or lifting line. A line-forwarding device is also provided for use in forwarding control lines of the winch assemblies to an access opening in the tank.

12 Claims, 5 Drawing Sheets

FIG. 9
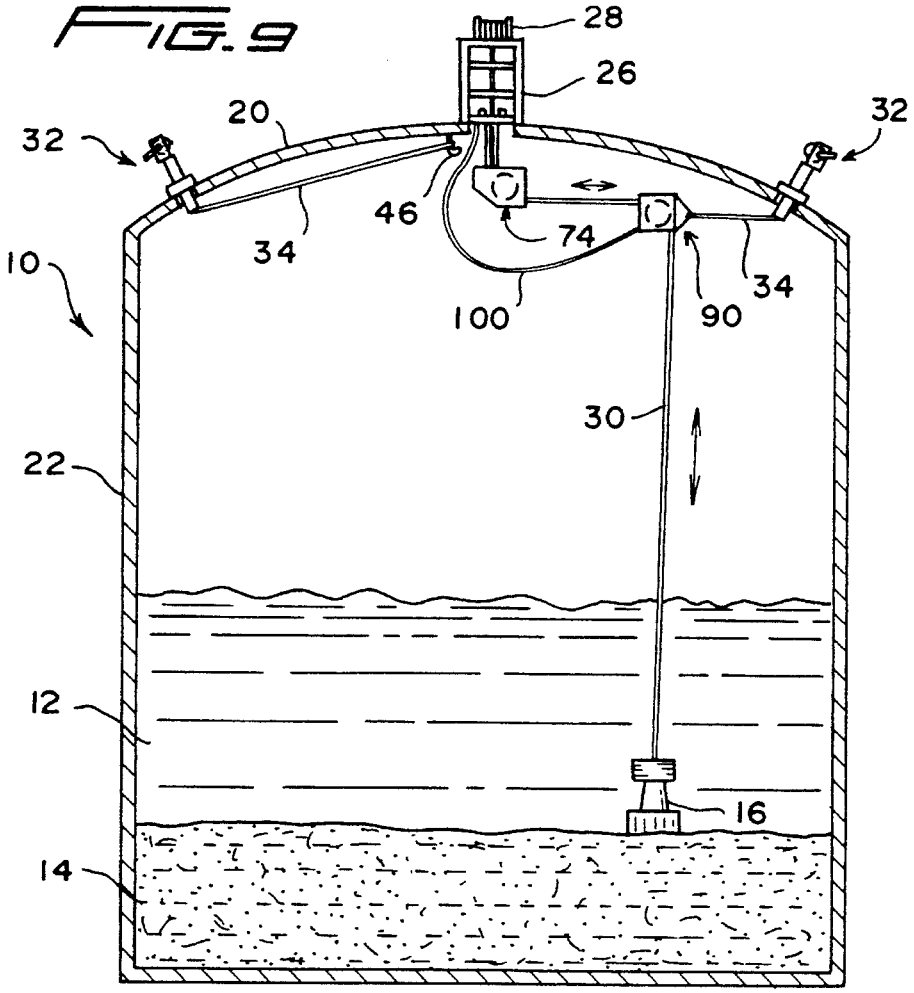
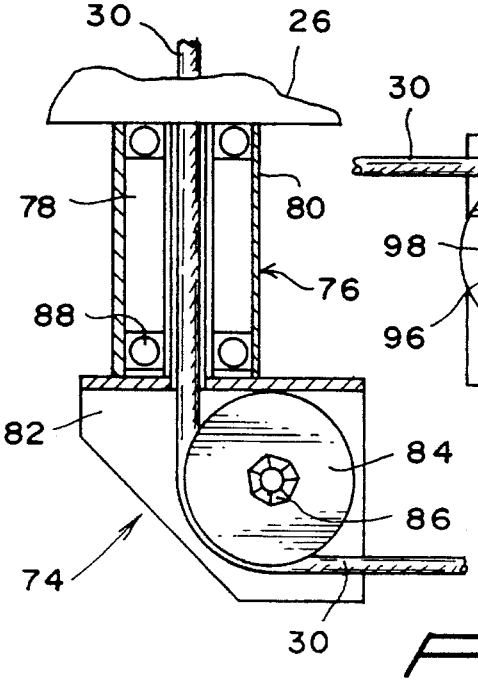
FIG. 10
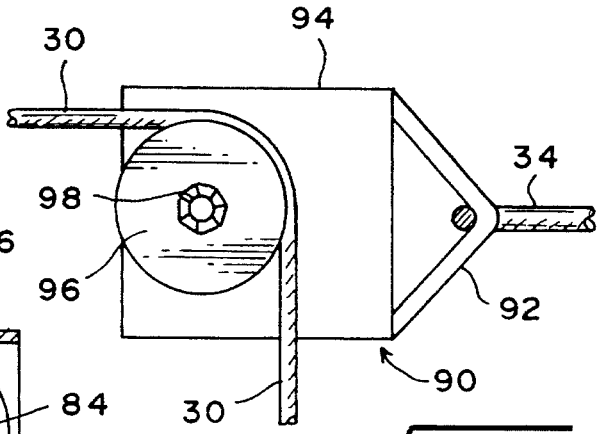
FIG. 11

METHOD OF OPERATION OF POSITIVE GUIDANCE SYSTEM FOR A TANK-CLEANING DEVICE

BACKGROUND OF THE INVENTION

The present invention relates to the field of tank cleaning, and more particularly to an improved system and method for positively guiding a tank-cleaning device or the like around the inside of a tank.

Material handling units, such as holding tanks or the like, are used in a wide range of industries, such as pulp and paper industries, chemical industries, mining and refining industries and steel industries. One problem that exists with the use of such holding tanks is that, over time, the liquid in the holding tank can no longer dissolve solids therein, and the solids fall out or are precipitated and load the bottom of the tank. Such fallout reduces tank capacity, stop pumps, and, in some instances, locks in valuable capital costs of material. Often, the buildup of solids in the tank occurs well before management personnel become aware of the problem, thereby resulting in tons of precipitated solids collected in the bottom of the tank. Tanks vary in size and shape and, in some instances, can be at least 40 feet high by 100 feet in diameter. Obviously, due to the nature holding tanks, removal of solids or sludge from the bottom thereof is not simple task. However, due to the aforementioned disadvantages of sludge buildup, such tanks must often be periodically cleaned.

One method and device which can be used to remove solids or sludge from the bottom of a tank is disclosed in U.S. Pat. No. 5,253,812, issued to the instant inventor. Such devices are designed to be placed in a tank on top of the solid deposit or sludge and include cutting wheels for breaking down and facilitating removal of the sludge from the tanks. While this and similar cleaning devices have proved to be useful in removing sludge from tanks, they require hydraulic motors and propellers for movement around the inside of the tank. As explained in the '812 patent, by generating both vertical and horizontal propulsion, it is possible to cause the cleaning device to move randomly around the bottom of the tank to facilitate cleaning thereof. However, in some instances, the hydraulic motors and propellers do not provide sufficient control of the movement of the cleaning device within the tank. Thus, a need exists for a method and device which enables improved control of the directional movement of a cleaning device, or the like, while operating within a tank.

SUMMARY OF THE INVENTION

A primary object of the present invention is to provide a system and method for enabling positive guidance of a tank-cleaning unit, or the like, while operating within a tank.

A more specific object of the present invention is to provide a system and method which enable a tank-cleaning unit to be easily and selectively positioned at any location within a tank.

A further object of the invention is to provide a system and method for enabling substantially all of the sludge within a tank to be efficiently removed therefrom by enabling systematic movement of a cleaning device within the tank.

Another object of the invention is to provide a system and method for enabling positive guidance of a tank-cleaning device which can be easily and efficiently installed and used on a variety of tanks.

Yet another object of the invention is to provide a system for enabling positive guidance of a tank-cleaning device which can be easily removed from the tank after use without adversely affecting the tank.

These and other objects and advantages are achieved by the present invention, which provides a positive guidance system for controlling directional movement of a tank-cleaning device within a tank, wherein the tank includes a plurality of control line openings radially spaced around the top perimeter of the tank and at least one access opening in the top of the tank for enabling the cleaning unit to enter the tank. The positive guidance system comprises a plurality of winch assemblies adapted to be mounted in the control line openings, respectively, wherein each of the winch assemblies includes a control line and means for enabling selective extension and retraction of the control line within the tank, the control line having an end portion adapted to be connected to the cleaning unit, and further including means for forwarding the control line of each of the winch assemblies to the access opening for selective connection with the cleaning unit as it enters the tank. The winch assemblies are operable upon connection to the cleaning unit to enable selective movement thereof within said tank by selective operation of the winch assemblies.

In accordance with one embodiment of the invention, the means for forwarding the control line comprises a chain assembly including stop means for causing the chain assembly to curve in only one direction, and a feed tube for receiving the chain assembly, wherein the feed tube is adapted to mount in any of the control line openings, such that a first end portion thereof extends out of the tank and a second end portion thereof extends substantially horizontally within the tank. The feed tube enables the chain assembly, when fed partially therethrough, to extend substantially horizontally beyond the second end of the feed tube within the tank, and further wherein the feed tube is operable to pivot in the control line opening to enable the chain assembly to forward the control line of selected winch assemblies to the access opening.

One embodiment of the method of the present invention includes the steps of mounting a plurality of winch assemblies in the control line openings of the tank, respectively, forwarding an end portion of the control line of each of the winch assemblies to a position adjacent the access opening in the tank, connecting the end portion of the control line of selected winch assemblies with the cleaning unit when the working unit is placed in the tank through the access opening, and selectively operating the winch assemblies having a control line connected to the cleaning unit to cause desired movement of the cleaning unit within the tank.

In accordance with another embodiment of the invention, a system and method is provided which enables a cleaning unit to be selectively raised and lowered at desired locations within the tank, by connecting the control lines of the winch assemblies to a lifting line of a cleaning unit lifting winch mounted above the access opening in the tank, wherein the control lines are connected to the lifting line through the use of a pulley device.

BRIEF DESCRIPTION OF THE DRAWINGS

Other objects and advantages of the subject invention will become apparent from a study of the following specification when viewed in light of the accompanying drawings, in which:

FIG. 9 depicts an alternative embodiment of the positive guidance system of FIGS. 1 and 2;

FIG. 10 shows a first pulley device used in the embodiment of FIG. 9;

FIG. 11 shows a second pulley device used in the embodiment of FIG. 9.

DETAILED DESCRIPTION OF THE PREFERRED EMBODIMENTS

Figure 1:
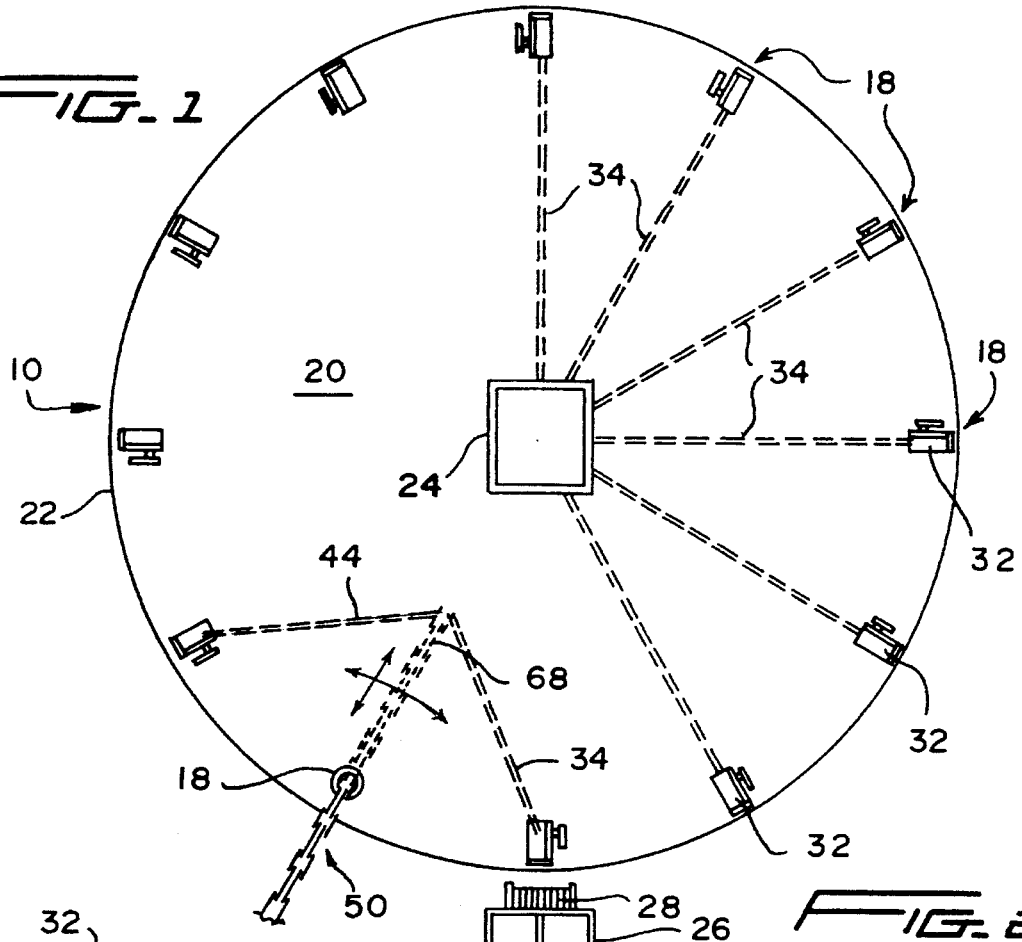
FIG. 1 depicts a top view of a tank and the positive guidance system of the present invention.
Figure 2:
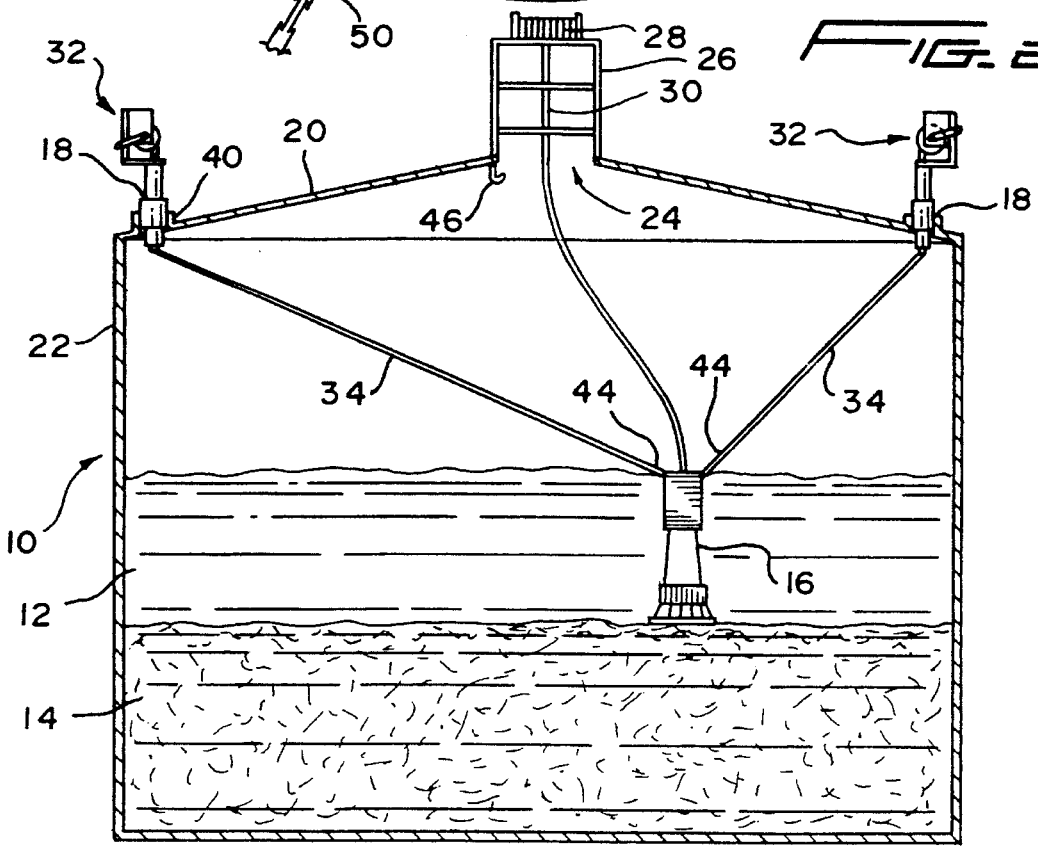
FIG. 2 depicts a side view of the tank of FIG. 1 with the positive guidance system in operation.

Referring now to the drawings, wherein like numerals designate similar parts throughout the various views, and more particularly to FIGS. 1 and 2 thereof, the system and method of the present invention is designed for use with a holding tank 10, which may form a part of a manufacturing or processing facility (not shown). The tank 10 may be of substantially any size or configuration. The tank 10 typically receives a liquid 12, containing a suspended or dissolved solid, which when the liquid 12 becomes saturated, sludge 14 settles or precipitates out of the liquid and falls to the bottom of the tank 10.

As will be explained in detail below, the system and method of the present invention is designed to aid in the removal of sludge 14 from the bottom of tank 10, by positively guiding or directing a sludge removal device 16 or the like operating within the tank 10. A suitable sludge removal device for use with the present invention is disclosed in U.S. Pat. No. 5,253,812, which is hereby incorporated by reference Inasmuch as the present invention is directed to a guidance system and method for use with a tank-cleaning device 16, and not to the tank-cleaning device 16 itself, further details regarding the operation of the cleaning device 16 will not be further discussed herein. It is noted, however, that the present invention is not limited to use with the tank-cleaning device of the '812 patent or the like, but can be used with any suitable device 16 which operates inside a tank 10 for which positive guidance is desired.

In accordance with the present invention, a plurality of control line openings 18 are provided in a top portion 20 of tank 10 adjacent a side portion 22 thereof. Preferably, the control line openings 18 are evenly, radially spaced around the perimeter of the top portion 20 of tank 10. The control line openings 18 are, for example, approximately four inches in diameter, spaced eighteen to twenty inches from the side portion 22 of the tank 10, and spaced approximately sixteen to twenty feet apart from one another. At least one access opening 24 is also provided in the top portion 20 of tank 10 for enabling the tank-cleaning device 16 to be placed inside and removed from the tank 10. Preferably, the access opening 24 is centrally located in the top portion 20 of the tank 10. However, depending on the size of the tank and the operation of the cable forwarding device, described below, multiple access openings 24 may be provided at selected locations in the top portion 20 of the tank 10. For example, on large tanks, i.e. being around one hundred feet in diameter, three access openings 24 may be provided at evenly, radially spaced locations in the top of the tank 10. If multiple access openings 24 are used, they are preferably located at a distance from the edge of the tank which is approximately one-third to one-half of the radius of the tank. Typically, the access opening is a square opening having sides of approximately thirty inches in length. A tower 26 having a lifting winch 28 for operating a lifting cable 30 is preferably attached to the tank 10 above the access opening 24, such that the lifting cable 30 can be attached to the top of the cleaning device 16 for raising and lowering the cleaning device 16 within the tank 10. The tower 26 may be similar in construction to the tower disclosed in the '812 patent.

Figure 3:
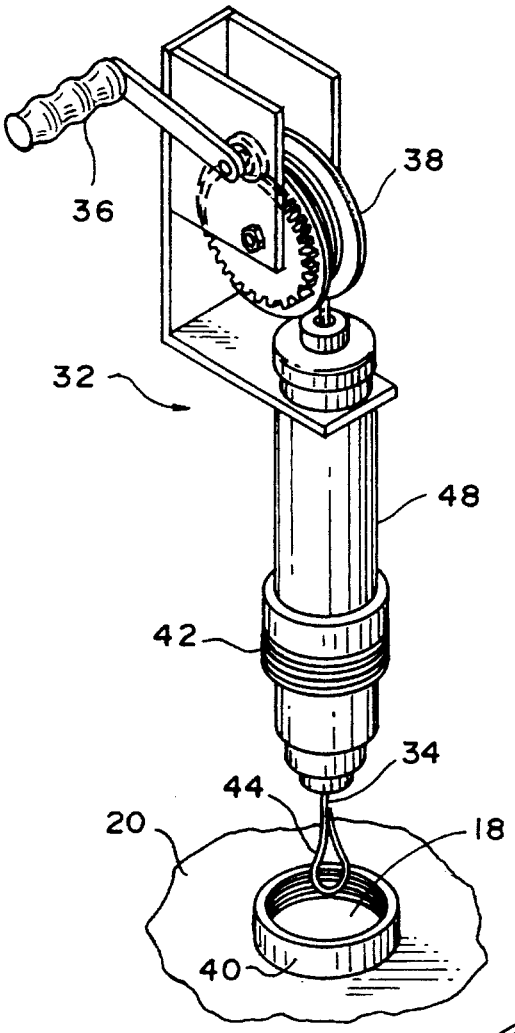
FIG. 3 shows a winch assembly in accordance with the present invention.
Figure 4:
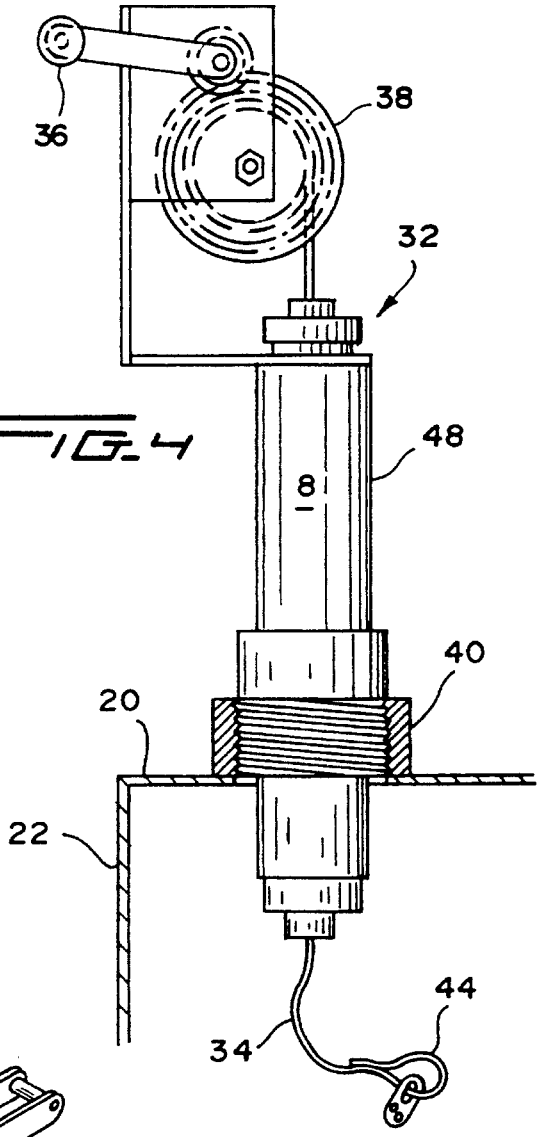
FIG. 4 shows the winch assembly of FIG. 3 mounted in a control line opening of a tank.
Figure 5:
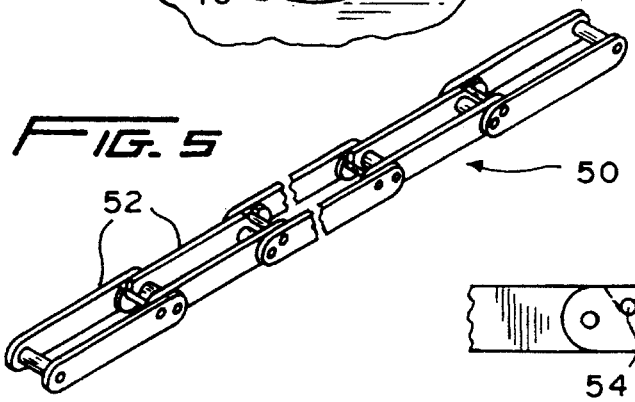
FIGS. 5 and 6*a* show a preferred embodiment of the chain used in the line forwarding device of the present invention.
Figure 6A:
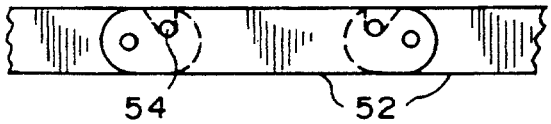
Figure 6B:
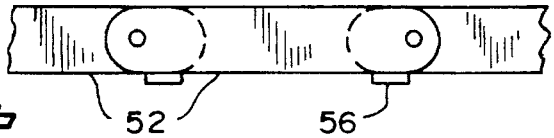
FIG. 6*b* shows an alternative embodiment of the chain of FIGS. 5 and 6*a;*

In accordance with the present invention, a plurality of winch assemblies 32 are provided for removably mounting in the control line openings 18, respectively, as seen most clearly in FIGS. 3 and 4. Preferably, a threaded coupler 40 is welded to the tank 10 around each of the control line openings 18 to facilitate mounting of the winch assemblies 32 in the control line openings 18, through the use of cooperating threads 42 on each of the winch assemblies 32. Each of the winch assemblies 32 includes a control line 34 which is extendable and retractable within the tank by operation of the winch 32 in a known manner, for example, by manually turning the winch handle 36 to cause winding of the control line 34 on the winch spool 38. Electrically or hydraulically driven winch assemblies or the like may alternatively be used.

The control lines 34 of each of the winch assemblies 32 include an end portion 44 adapted for connection to the cleaning device 16. Upon connection of a control line 34 to the cleaning device 16, the respective winch assembly which operates on the connected control line 34 can be used to move the cleaning device 16 across the tank towards the connected winch assembly 32. Thus, by selectively connecting the control lines 34 to the cleaning device 16, the cleaning device 16 can be guided or moved along the surface of the sludge 14 in a desired path or to a desired location in the tank 10 by selective operation of the winch assemblies 32. Preferably, the control line 34 of each of the winch assemblies 32 is forwarded from the winch assembly 32 to the access opening 24 for selective connection to the cleaning device 16 upon entry of the cleaning device 16 into the tank 10 through the access opening 24. Hooks 46 or the like, as shown in FIG. 2, are preferably provided on the inside top portion of the tank adjacent the access opening for enabling the control lines 34 to be connected thereto for later use when not connected to the cleaning device 16. The control lines 34 are preferably tightened against the hooks 46 when not in use so that they do not interfere with the operation of the remaining control lines.

In operation, the lifting winch 28 on the tower 26 is used to raise and lower the cleaning unit 16 to and from the access opening 24 for enabling connection of the desired control lines 34 thereto. Each control line 32, upon connection to the cleaning device 16, enables positive guidance of the cleaning unit in a different direction. Moreover, by connecting two adjacent control lines 34 to the cleaning unit 16 and simultaneously operating the adjacent winches, the cleaning unit 16 can be moved to any location within the "pie slice"-shaped area defined by the two control lines. In this manner, the cleaning unit 16 can be moved or dragged across the sludge 14 in a desired path so as to promote complete and efficient removal of the sludge 14 by the cleaning unit 16. Preferably, the body portion 48 of the winch assembly which extends above the control line opening 18 outside of the tank 10 includes indicia thereon, such as a number, letter or the like, which indicia matches indicia on the end portion 44 of the control line 34, for enabling easy identification by an operator as to which control line 34 is connected to which winch when the system is installed on a tank. For example, as shown in FIG. 4, the body portion 48 of winch 32 and the end portion 44 of the control line 34 are both provided with a matching number "8" for easy identification.

In the embodiment of FIG. 1, only a single access opening 24 is provided and each of the control lines is forwarded thereto. However, on a large tank where forwarding the control line 34 all the way to a centrally located access opening 24 may be problematic, a plurality of access openings may be used which are positioned closer to certain winch assemblies 32, respectively. If this is the case, then, in accordance with the invention, the control lines are forwarded to the nearest access opening for each winch assembly 32, and the cleaning unit is, in turn, lowered from each access opening to remove sludge 14 from each area of the tank 10.

As shown in FIGS. 5–8, a line forwarding device is provided for enabling the control lines 34 to be forwarded from the winch assemblies 32 to the access opening 24, where the control lines are either connected to the cleaning unit 16 or tightened against hooks 46 for later use. In accordance with a preferred embodiment of the forwarding device, a chain 50 having links 52 is provided wherein the chain includes stops in the form of pins 54, as shown in FIG. 6*a*, or blocks 56, as shown in FIG. 6*b*. The stops cause the chain 50 to only be able to bend or curve in one direction. In other words, the chain will curve in one direction, but will remain linear, due to pins 54 or stops 56, if an attempt is made to bend it in the other direction.

Figures 7, 8:
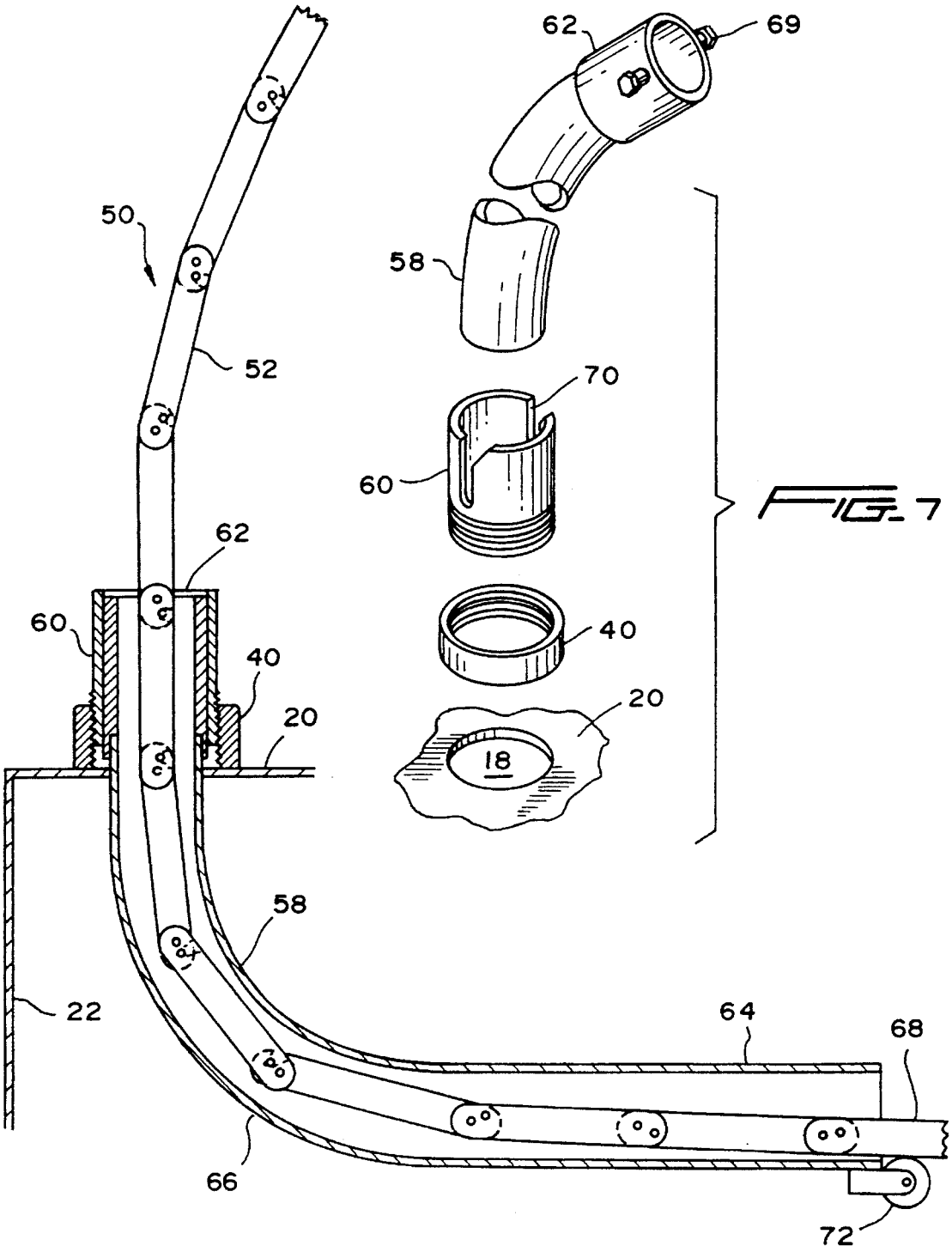
FIG. 7 shows a partial view of the feed tube used in the line forwarding device of the present invention.
FIG. 8 show the line forwarding device of the present invention in operation in a control line opening of a tank.

As shown in FIGS. 7 and 8, the forwarding device further includes a feed tube 58 which is curved substantially ninety degrees. The feed tube 58 is adapted to be inserted and mounted in any one of the control line openings 18, in place of a winch assembly 32, through the use of a collar 60 which threads into the coupler 40. When mounted in the control line opening 18, the feed tube has a first end portion 62 which extends out of the tank 10 through the control line opening 18 and a second end portion 64 which extends substantially horizontally within the tank 10. The second end portion 64 may be provided with a roller 72. The first end portion 62 may be provided with holding bolts 69 which are received in respective slots 70 in the collar 60. When the chain 50 is fed into the feed tube 58, such that it can bend in accordance with the bent portion 66 in the feed tube 58, an end portion 68 of the chain 50 which extends out of the end portion 64 of the feed tube will extend substantially horizontally within the tank. By feeding more or less of the chain 50 into the feed tube 58, the end portion 68 of the chain 50 will extend a greater or lesser distance horizontally within the tank 10. It has been found that this type of chain 50 and feed tube 58 will enable the end portion 68 of the chain 50 to extend at least twenty two feet horizontally within the tank 10.

In accordance with the invention, the feed tube 58 is operable to pivot within the control line opening 18 (as shown most clearly in FIG. 1), to enable the end portion 68 of the chain 50 to pivot to a position near adjacent control line openings 18, thereby enabling the end portion 44 of control lines 34 to be connected to the end portion 68 of chain 50 and forwarded therewith to the access opening 24. Thus, the line-forwarding device is used in any control line opening 18 to enable the control lines 34 of adjacent winch assemblies 32 to be forwarded to the access opening 24. As explained above, the control lines 34, once forwarded to the access opening 24, can either be connected with the cleaning device 16 or simply connected to and tightened against hooks 46 adjacent the access opening 24 for use at a later time. If multiple access openings are used, the forwarding device can be used to forward control lines 34 to the nearest access opening for each winch assembly 32. While the chain 50 and feed tube 58 represent a preferred form of the forwarding device, any other suitable means for forwarding the control line 34 to the access opening 24 can be used. For example, it is within the scope of the present invention to use a projection device (not shown), such as a cross-bow, or the like, to project a feed line (not shown) from the access opening 24 to a position adjacent the side portion 22 of the tank 10, such that an operator can reach the feed line through a control line opening 18 and connect the control line to the feed line, to enable the feed line to be used to forward the control line 32 to the access opening 24. In accordance with the invention, a catching device (not shown), such as a loop formed by a band saw blade or the like, can be inserted through a control line opening 18 to form a target loop for the projection device to shoot the feed line therethrough, thereby catching the feed line and enabling the operator to retrieve the feed line through the control line opening 18, so that the feed line can be used directly or indirectly to forward the control line 34 to the access opening 24. Once all of the control lines 34 are forwarded to the access opening 24, the forwarding device is no longer needed unless a control line is dropped from the access opening, or breaks.

Referring now to FIGS. 9–11, there is shown an alternative embodiment of the present system and method, which, rather than dragging the cleaning unit 16 along the sludge as described above, enables the cleaning unit 16 to be selectively raised and lowered into and out of the sludge 14 at substantially every location within the tank 10. In this embodiment, the same control line openings 18, winch assemblies 32, access opening 24, line forwarding device, and lifting tower 26 with lifting winch 28 are provided as described above. However, the tower 26 includes a first pully device 74, shown in greater detail in FIG. 10, extending through the access opening 24 into the tank 10. The first pully device 74 is rotatable about a vertical axis defined by a depending shaft 76 connected to the bottom of the tower 26. Preferably, the shaft 76 includes a fixed outer tube 80 secured to the tower 26, and an rotatable inner tube 78 connected to a pulley plate 82 on which a pulley 84 is mounted thereon by nut 86. The shaft 76 may include bearings 88 for enabling smooth rotation of the inner tube 78. Winch line 30 is fed through the shaft 76 and around the pully 84 as shown in FIG. 10. The first pully device 74 is operable to rotate substantially three hundred and sixty degrees, such that the pulley 84 can selectively face, and feed the lifting line 30, towards any one of the winch assemblies 32.

A second pulley device 90 is provided, as shown in FIG. 11, having a connector 92 for enabling the end portion of the control line 34 of any of the winch assemblies 32 to be selectively connected thereto. The second pulley device 90 further includes a pulley plate 94 to which a pulley 96 is connected by nut 98. The second pulley device 90 is adapted to receive the lifting line 30 around the pulley 96 at a position intermediate the first pulley device 74 and the tank-cleaning device 16. By connecting the second pulley device 90 to a selected control line 34 and operating the associated winch assembly 32, the second pulley device 90 is operable to pull the lifting line 30 towards the associated winch assembly 32. Thus, by operating the lifting winch the tank-cleaning device can be raised and lowered at a location in the tank below the second pulley device 90. In this manner, and by selectively retracting or extending the control line 34 of the winch assembly 32 connected to the second pully device 90, the tank-cleaning unit 16 can be selectively raised and lowered at various locations within the tank. By selectively connecting the second pulley device 90 to control lines 34 of different winch assemblies 32, the tank-cleaning device can be raise and lowered substantially anywhere within the tank 10 to facilitate sludge removal. A tag line 100 is connected to the second pulley device 90 to enable it to be retrieved back to the access opening 24 for disconnection and connection to selected control lines 34. In this embodiment, it is not necessary to connect any control lines directly to the tank-cleaning unit. However, if desired, selected control lines can also be connected directly to the cleaning unit to provide addition control over the direction of movement thereof.

Figure 12A:
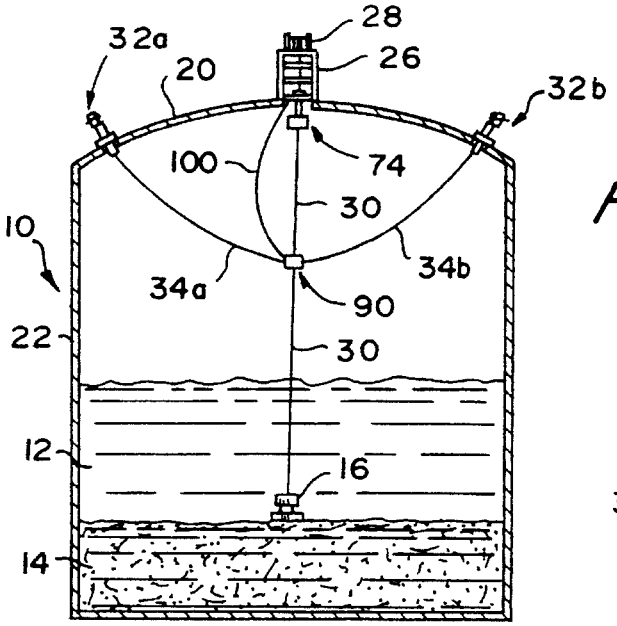
FIGS. 12*a*–12*c* show one method of operating the system of FIG. 9.
Figure 12B:
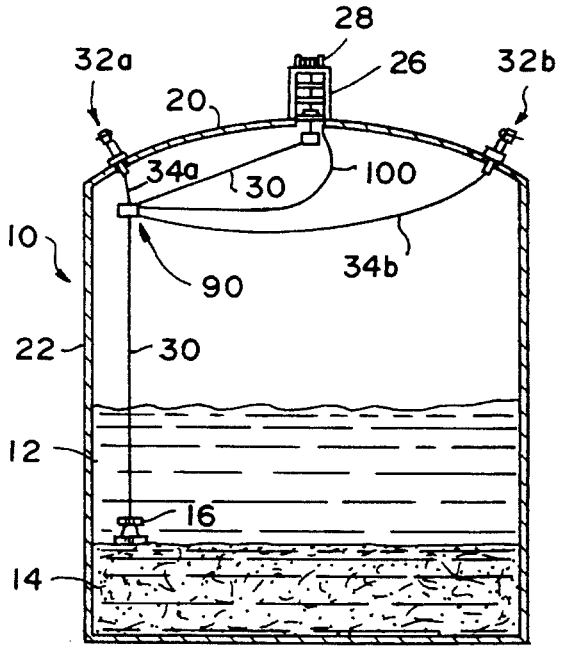
Figure 12C:
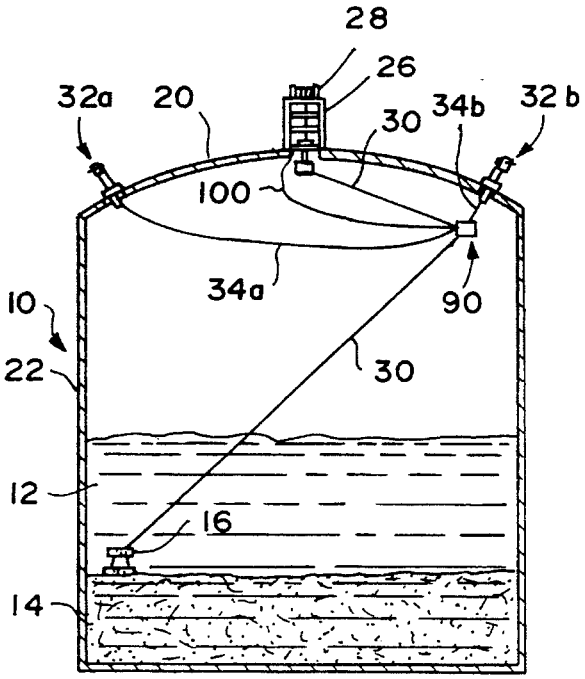

As shown in FIGS. 12*a*–12*c*, this embodiment can be used to move the cleaning device 16 across the sludge 14 from one side of the tank 10 to the other. This is achieved by lowering the cleaning device 16 onto the sludge 14 with the lifting winch 28 at a location directly below the access opening 24, and selectively connecting at least two control lines 34*a* and 34*b* of opposed winch assemblies 32*a* and 32*b*, respectively, to the second pulley device 90, as shown in FIG. 12*a*. By tightening the control line 34*a*, while allowing control line 34*b* to extend, the second pulley device 90 is moved to a position below the winch 32*a*. In this position, the lifting winch 28 is used to slightly raise and pull the cleaning unit 16, with the help of the force of gravity, to a location directly below the winch 32*a*, as shown in FIG. 12*b*. Next, control line 34*b* is tightened, while control line 34*a* is allowed to extend, to cause the second pulley device 90 to move to a location below winch assembly 32*b*, as shown in FIG. 12*c*. In this position, the lifting winch 28 can be used to cause the cleaning unit 16 to move across the tank to a position directly below the winch assembly 32*b*. In this manner, and by selectively connecting various control lines to the second pulley device, the cleaning unit 16 can be selectively moved around the inside of the tank 10 to facilitate cleaning thereof. With this method, the lifting winch 28 is preferably a power driven winch which performs all movement of the cleaning device 16, and the hand winch assemblies 32*a* and 32*b* are only used to relocate the second pulley device 90 when not under load by the cleaning device 16.

After the tank 10 has been cleaned by the cleaning device 16, the winch assemblies 32 can either be removed from the control line openings 18 or simply left on the tank 10 with the control lines 34 thereof connected with and tightened against hooks 46 for use the next time the tank is cleaned. If the winch assemblies are removed, removable caps (not shown) can be placed on the control line openings 18. A removable closure (not shown) can also be used to close the access opening 24 when not in use. Thus, the present system can be easily installed and/or removed from the tank 10 without adversely affecting the operation of the tank.

While the preferred forms and embodiments of the invention have been illustrated and described, it will be apparent to those of ordinary skill in the art that various changes and modifications may be made without deviating from the inventive concepts and spirit of the invention as set forth above, and it is intended by the appended claims to define all such concepts which come within the full scope and true spirit of the invention.

What is claimed is:

1. A method for positive guidance of a working unit which performs work inside a tank having a top portion and a side portion, wherein said tank includes a plurality of spaced control line openings in said top portion adjacent said side portion and an access opening in said top portion for enabling said working unit to enter said tank, said method comprising the steps of mounting a plurality of winch assemblies in said control line openings, respectively, wherein each of said winch assemblies includes a control line and means for enabling selective extension and retraction of said control line within said tank, forwarding an end portion of said control line of each of said winch assemblies to a position adjacent to said access opening, placing said working unit in said tank through said access opening, connecting said end portion of said control line of selected winch assemblies with the working unit when said working unit is placed in said tank, and selectively operating said winch assemblies having a control line connected to said working unit to cause desired movement of said working unit within said tank.

2. The method as defined by claim 1, further including the initial step of making said control line openings in the top portion of said tank.

3. The method as defined by claim 2, wherein the step of making said control line openings further includes making said control line openings in said tank at evenly, radially spaced locations around said top portion of said tank.

4. The method as defined by claim 3, further including the step of making said access opening in said top portion of said tank prior to placing said working unit in said tank.

5. The method as defined by claim 1, wherein after selectively operating said winch assemblies, said method further includes the step of raising said working unit to said access opening and selectively connecting control lines of different winch assemblies to said working unit to enable different movement of said working unit within said tank by selective operation of said different winch assemblies.

6. The method as defined by claim 1, wherein said working unit is operable to remove sludge from said tank, and further including the step of selectively connecting said control lines to said working unit and selectively operating said winch assemblies to facilitate removal of said sludge by said working unit.

7. The method as defined by claim 1, further including the step of connecting said end portion of each control line of said plurality of winch assemblies to said tank adjacent said access opening when not in use.

8. The method as defined by claim 1, further including the step of removing said winch assemblies from said control line openings after said working unit has finished performing said work, and placing a removable closure on said control line openings and said access opening until a next time when said tank requires work to be performed therein by said working unit.

9. Method of guiding a working unit performing work inside a tank, wherein said tank includes a top portion and a side portion, a plurality of control line openings in said top portion adjacent said side portion, and an access opening in said top portion for enabling said working unit to enter said tank, said method comprising the steps of: mounting a plurality of winch assemblies in said control line openings, respectively, wherein each of said winch assemblies includes a control line and means for enabling selective extension and retraction of said control line within said tank, mounting, above said access opening, a working unit lifting winch assembly having a lifting line, wherein said lifting winch assembly includes a first pulley device extending within said tank and being rotatable about a vertical axis such that said pulley device is operable to selectively feed said lifting line towards any one of said winch assemblies, providing a second pulley device operable to be selectively connected to said control line of at least one of said winch assemblies, feeding said lifting line through said second pulley device, selectively connecting said second pulley device to said control line of at least one of said winch assemblies, and selectively operating said at least one of said winch assemblies having a control line connected to said second pulley device such that said second pulley device moves with said lifting line therein to a desired distance from said first pulley device, and operating said lifting winch assembly to selectively move said working unit within said tank.

10. The method as defined in claim 9, further including the step of either extending or retracting said at least one of said winch assemblies having a control line connected to said second pulley device to a different desired distance from said first pulley device, and operating said lifting winch assembly to selectively raise and lower said working unit within said tank.

11. The method as defined in claim 9, further including the step of disconnecting said second pulley device from said control line of said at least one winch assembly, connecting said control line of at least one different winch assembly, and selectively operating said at least one different winch assembly to cause said working unit to be selectively raised and lowered at a different location in said tank.

12. The method as defined in claim 9, wherein said working unit is operable to remove sludge from said tank, and further including the step of selectively connecting said control lines to said second pulley device and selectively operating said winch assemblies and said lifting winch assembly to facilitate removal of said sludge by said working unit.

* * * * *